US010871294B2

(12) United States Patent
Guilherme

(10) Patent No.: US 10,871,294 B2
(45) Date of Patent: Dec. 22, 2020

(54) HEATING DEVICE AND METHOD FOR OPERATING A HEATING DEVICE

(71) Applicant: BOSCH TERMOTECNOLOGIA S.A., Cacia Aveiro (PT)

(72) Inventor: David Carvalho Guilherme, Aveiro (PT)

(73) Assignee: BOSCH TERMOTECNOLOGIA S.A., Cacia Aveiro (PT)

( * ) Notice: Subject to any disclaimer, the term of this patent is extended or adjusted under 35 U.S.C. 154(b) by 127 days.

(21) Appl. No.: 15/761,328

(22) PCT Filed: Sep. 26, 2016

(86) PCT No.: PCT/EP2016/072799
§ 371 (c)(1),
(2) Date: Mar. 19, 2018

(87) PCT Pub. No.: WO2017/055198
PCT Pub. Date: Apr. 6, 2017

(65) Prior Publication Data

US 2018/0266703 A1 Sep. 20, 2018

(30) Foreign Application Priority Data

Sep. 28, 2015 (PT) ..... 108844

(51) Int. Cl.
*F24D 19/10* (2006.01)
*F24H 9/20* (2006.01)
(Continued)

(52) U.S. Cl.
CPC ..... *F24D 19/1021* (2013.01); *F24D 19/10* (2013.01); *F24H 1/12* (2013.01);
(Continued)

(58) Field of Classification Search
CPC ..... F24D 19/10; F24D 19/1021; F24D 2220/0235; F24D 2220/042; F24H 1/12;
(Continued)

(56) References Cited

U.S. PATENT DOCUMENTS 9,010,280 B2 * 4/2015 Adachi ..... F24D 17/0031 122/14.1
2007/0257122 A1 * 11/2007 Shimada ..... F23N 1/082 237/12

FOREIGN PATENT DOCUMENTS

CA 2883083 A1 8/2016
CN 2262691 Y 9/1997
(Continued)

OTHER PUBLICATIONS

International Search Report dated Dec. 5, 2016, of the corresponding International Application PCT/EP2016/072799 filed Sep. 26, 2016.

*Primary Examiner* — Steven B McAllister
*Assistant Examiner* — Benjamin W Johnson
(74) *Attorney, Agent, or Firm* — Norton Rose Fulbright US LLP; Gerard Messina

(57) ABSTRACT

A heating device, including at least one heating unit, which is configured to heat at least one fluid; at least one fluid supply line, which is provided for supplying the fluid to the heating unit for heating; at least one fluid discharge line, which is provided for discharging the fluid from the heating unit after the heating; and a control and/or regulating unit, which is configured to operate the heating unit in a pulsed manner, in at least one operating state, in order to set a particular temperature. The heating device includes a valve unit, which is configured to mix the fluid in the fluid discharge line with fluid from the fluid supply line, upstream from an outlet.

9 Claims, 4 Drawing Sheets

(51) Int. Cl.

| | |
|---|---|
| ***F24H 1/12*** | (2006.01) |
| ***F24H 1/44*** | (2006.01) |
| ***F24H 9/18*** | (2006.01) |

(52) U.S. Cl.
CPC ..... *F24H 1/122* (2013.01); *F24H 1/44* (2013.01); *F24H 9/1818* (2013.01); *F24H 9/20* (2013.01); *F24H 9/2014* (2013.01); *F24D 2220/0235* (2013.01); *F24D 2220/042* (2013.01)

(58) Field of Classification Search
CPC ... F24H 1/122; F24H 1/22; F24H 1/44; F24H 9/1818; F24H 9/20; F24H 9/2014
USPC ..... 122/14.3
See application file for complete search history.

(56) References Cited

FOREIGN PATENT DOCUMENTS

| | | | |
|---|---|---|---|
| CN | 2285447 | Y | 7/1998 |
| CN | 2371511 | Y | 3/2000 |
| CN | 201028756 | Y | 2/2008 |
| CN | 101464051 | A | 6/2009 |
| CN | 101988734 | A | 3/2011 |
| JP | H10300209 | A | 11/1998 |
| WO | 2012009213 | A1 | 1/2012 |

* cited by examiner

HEATING DEVICE AND METHOD FOR OPERATING A HEATING DEVICE

FIELD

The present invention relates to a warm water reservoir, as well as to a method.

BACKGROUND INFORMATION

A conventional heating device, which includes at least one heating unit that is configured to heat at least one fluid, includes at least one fluid supply line, which is provided for supplying the fluid to the heating unit for heating, and at least one fluid discharge line, which is provided for discharging the fluid from the heating unit after the heating. The heating unit is operated in a pulsed manner with the aid of a control and/or regulating unit, in order to set a particular temperature.

SUMMARY

The present invention relates to a heating device, including at least one heating unit, which is configured to heat at least one fluid; at least one fluid supply line, which is provided for supplying the fluid to the heating unit for heating; at least one fluid discharge line, which is provided for discharging the fluid from the heating unit after the heating; and a control and/or regulating unit, which is configured to operate the heating unit in at least one operating state, in order to set a particular temperature.

It is provided that the heating device include a valve unit, which is configured to mix the fluid in the fluid discharge line with fluid from the fluid supply line, upstream from an outlet.

In this connection, a "heating device" is to be understood, in particular, as at least a part, in particular, a submodule of a heater, and preferably, of a continuous-flow heater. In particular, the heating device may also include the entire heater, and preferably, the entire continuous-flow heater. In this connection, a "heating unit" is to be understood, in particular, as a unit, which is configured to convert energy, in particular, electrical energy, bioenergy and/or, preferably, fossil energy into heat, in particular, directly, and to supply it, in particular, to a fluid, advantageously, water. In particular, the heating unit includes at least one heating module and, advantageously, at least one heat exchanger. In this context, the heating module may take the form of an electric heater and/or of, advantageously, a burner, in particular, an oil burner and, particularly preferably, a gas burner, and, advantageously, is thermally connected to the heat exchanger, in order to heat the fluid. The heat exchanger includes, in particular, at least one supply line for an, in particular, unheated fluid and/or fluid to be heated; and, in particular, at least one outlet for a fluid heated, in particular, by the heating module. In this connection, that the "heating unit is configured to heat a fluid" is to be understood to mean that in at least one operating state, the heating unit and, in particular, the heating module are configured to increase a temperature of the fluid by at least 5° C., advantageously, by at least 15° C., preferably, by at least 25° C., and, particularly preferably, by at least 35° C., in comparison with a reference temperature and/or an initial temperature. In particular, "configured" is to be understood as specially programmed, designed, and/or equipped. An object being provided for a certain function is to be understood to mean, in particular, that the object fulfills and/or executes this particular function in at least one state of application and/or operating state.

In addition, a "control and/or regulating unit" is to be understood, in particular, as an electric and/or electronic unit having at least control electronics. "Control electronics" are to be understood, in particular, as a unit including an arithmetic unit, a storage unit, as well as an operating, control and/or regulating program, which is stored in the storage unit and is intended, in particular, to be executed by the arithmetic unit. In the at least one operating state, the control and/or regulating unit is advantageously configured to operate the heating module in a pulsed manner, using at least two pulses, in order to, in particular, set and/or adjust a certain temperature. The control and/or regulating unit being configured to "operate" the heating unit and/or the heating module "in a pulsed manner" should be understood to mean, in particular, that the control and/or regulating unit is configured to operate the heating unit and/or the heating module in a clocked manner and/or discontinuously, and/or to supply it/them with energy, in particular, electric current and/or, advantageously, fuel. The control and/or regulating unit is advantageously configured, in particular, in a pulsed operation, to operate the heating unit and/or the heating module in a first time interval; and, in a second interval, in particular, directly following the first interval in time, to reduce a heating power of the heating module, in particular, in comparison with the first interval; and/or to advantageously adjust an operation of, in particular, the heating unit and/or the heating module, in particular, completely; and/or to completely disconnect a power supply. A first time interval immediately follows the second time interval in an advantageous manner. In this context, a first time interval determines, in particular, a pulse duration of one pulse of the at least two pulses. In this connection, the expression "short-term" is to be understood as, in particular, a period of time of, at a maximum, 200 s, preferably, at a maximum, 100 s, and particularly preferably, at a maximum, 50 s.

In this connection, a "valve unit" is to be understood as, in particular, a unit, which is configured, in particular, to block and/or stop a flow of fluids. In particular, the valve unit includes at least one, in particular, electromotively actuated valve and/or at least one electromagnetically actuated valve. In particular, the valve unit is controllable by the control and/or regulating unit. In particular, a valve position of at least one valve of the valve unit may be changed via activation by the control and/or regulating unit. The valve unit is positioned, in particular, fluidically at least partially between a fluid supply line, which is provided for supplying the fluid to the heating unit for heating, and a fluid discharge line, which is provided for discharging the fluid from the heating unit after the heating. The valve unit being configured "to mix fluid in the fluid discharge line with fluid from the fluid supply line upstream from an outlet" is to be understood to mean, in particular, that as a function of a valve position, the valve unit directs a volumetric flow of the fluid from the fluid supply line to the fluid discharge line, in particular, to reduce a fluid temperature to a desired outlet temperature.

In addition, the heating device may include at least one sensor, in particular, a flow rate sensor and/or temperature sensor, which is provided, in particular, for measuring at least one measured variable correlated with the fluid, in particular, a flow rate and/or a temperature.

Using such a refinement, a generic heating device having improved operating characteristics may be provided. In particular, advantageous flexibility and/or advantageous efficiency may be achieved, in particular, cost efficiency, weight efficiency and/or power efficiency. In addition, advantageously high temperature stability and/or advantageously flexible temperature adjustment may be rendered possible. Furthermore, comfort may be advantageously increased, in particular, for an end user; in particular, sudden temperature fluctuations being able to be minimized in an advantageous manner.

In addition, it is provided that the control and/or regulating unit be configured to control the valve unit in such a manner, that an at least substantially uniform outlet temperature of the fluid sets in. In this connection, the control and/or regulating unit being configured to control the valve unit in such a manner, that an at least substantially "uniform outlet temperature of the fluid sets in," is to be understood to mean, in particular, that the control and regulating unit is configured to set a rate of volumetric flow through the valve unit in such a manner, that an outlet temperature of the fluid having a fluctuation of a maximum of 3° C., advantageously, of a maximum of 2° C., and particularly preferably, of a maximum of 1° C., results. In this context, the control and/or regulating unit is advantageously configured to adjust a temperature of the fluid at, in particular, an outlet, at least substantially as desired, in a temperature range of 20° C. to 80° C., preferably, 30° C. to 70° C., and particularly preferably, 40° C. to 60° C. In this context, in particular, in the scope of an adjustment accuracy of the control and/or regulating unit, the expression "at least substantially as desired" is to be understood as arbitrarily. Through this, an outlet temperature may be set in an advantageously simple and/or reliable manner, with advantageously negligible temperature fluctuations.

In addition, it is provided that the control and/or regulating unit be configured to control the valve unit at least substantially synchronously with the pulsed operation of the heating unit. In this connection, "at least substantially synchronously" is to be understood to mean, in particular, that a control pulse generated and/or outputted by the control and/or regulating unit for controlling the heating unit is generated and/or outputted simultaneously to a control pulse for controlling the valve unit. In particular, the valve unit and the heating unit are controlled, using two at least substantially equal-frequency and synchronized, in particular, synchronous or oppositely directed control pulses. In this manner, advantageous synchronization of a pulsed operation of the heating unit and control of the valve unit may be achieved.

In addition, it is provided that the control and/or regulating unit be configured to increase a flow rate of fluid through the valve unit in response to increasing heating power of the heating unit, during the pulsed operation. In particular, in response to increasing heating power of the heating unit, the control and/or regulating unit is configured to increase a flow rate of fluid through the valve unit to such an extent, that an increase in an outlet temperature of the fluid above a setpoint temperature is offset at least substantially. Preferably, the control and/or regulating unit is further configured to reduce a flow rate of fluid through the valve unit during pulsed operation, in response to falling heating power of the heating unit. In particular, in response to falling heating power of the heating unit, the control and/or regulating unit is configured to reduce a flow rate of fluid through the valve unit to such an extent, that a decrease in the outlet temperature of the fluid below a set point temperature is at least substantially offset. In this manner, an outlet temperature of the fluid may advantageously be held constant.

In one preferred refinement of the present invention, it is provided that the valve unit include at least one bypass valve, which is situated fluidically in parallel with the heating unit. In this manner, a variable volumetric flow of a fluid may easily be directed from the fluid supply line to the fluid discharge line.

In one preferred refinement of the present invention, it is provided that the valve unit include at least one mixing valve, which is situated fluidically in the fluid discharge line. In this manner, fluid in the fluid discharge line may easily be mixed with a variable volumetric flow of a fluid from the food supply line in an advantageous manner.

In addition, it is provided that the control and/or regulating unit be configured to operate the heating unit in a pulsed manner, such that the fluid is heated to a temperature, which lies above a selected outlet temperature of the fluid. This advantageously allows a sufficiently high outlet temperature of the fluid to be obtained at any time.

Furthermore, a heater, in particular, continuous-flow heater, having at least one heating device according to the present invention, is provided. In this manner, a particularly flexible and/or efficient heater may be provided.

In addition, the present invention is directed to a method for operating a heating device including at least one heating unit, which is configured to heat at least one fluid; at least one fluid supply line, which is provided for supplying the fluid to the heating unit for heating; at least one fluid discharge line, which is provided for discharging the fluid from the heating unit after the heating; and a control and/or regulating unit, which is configured to operate the heating unit at least partially in a pulsed manner, in at least one operating state, in order to set a particular temperature; upstream from an outlet, the fluid in the fluid discharge line being mixed with fluid from the fluid supply line. This allows, in particular, a flexibility and/or an efficiency to be increased in an advantageous manner.

In this connection, the heating device of the present invention is not limited to the use and specific embodiment described above. In particular, the heating device of the present invention may include a number different from a number of individual elements, component parts and units mentioned here, in order to implement a method of functioning described here.

BRIEF DESCRIPTION OF THE DRAWINGS

Further advantages are derived from the description below of the figures. Two exemplary embodiments of the present invention are shown in figures. The figures and the description herein include numerous features in combination. One skilled in the art will advantageously consider the features individually, as well, and integrate them to form useful, further combinations.

DETAILED DESCRIPTION OF EXAMPLE EMBODIMENTS

Figure 1:
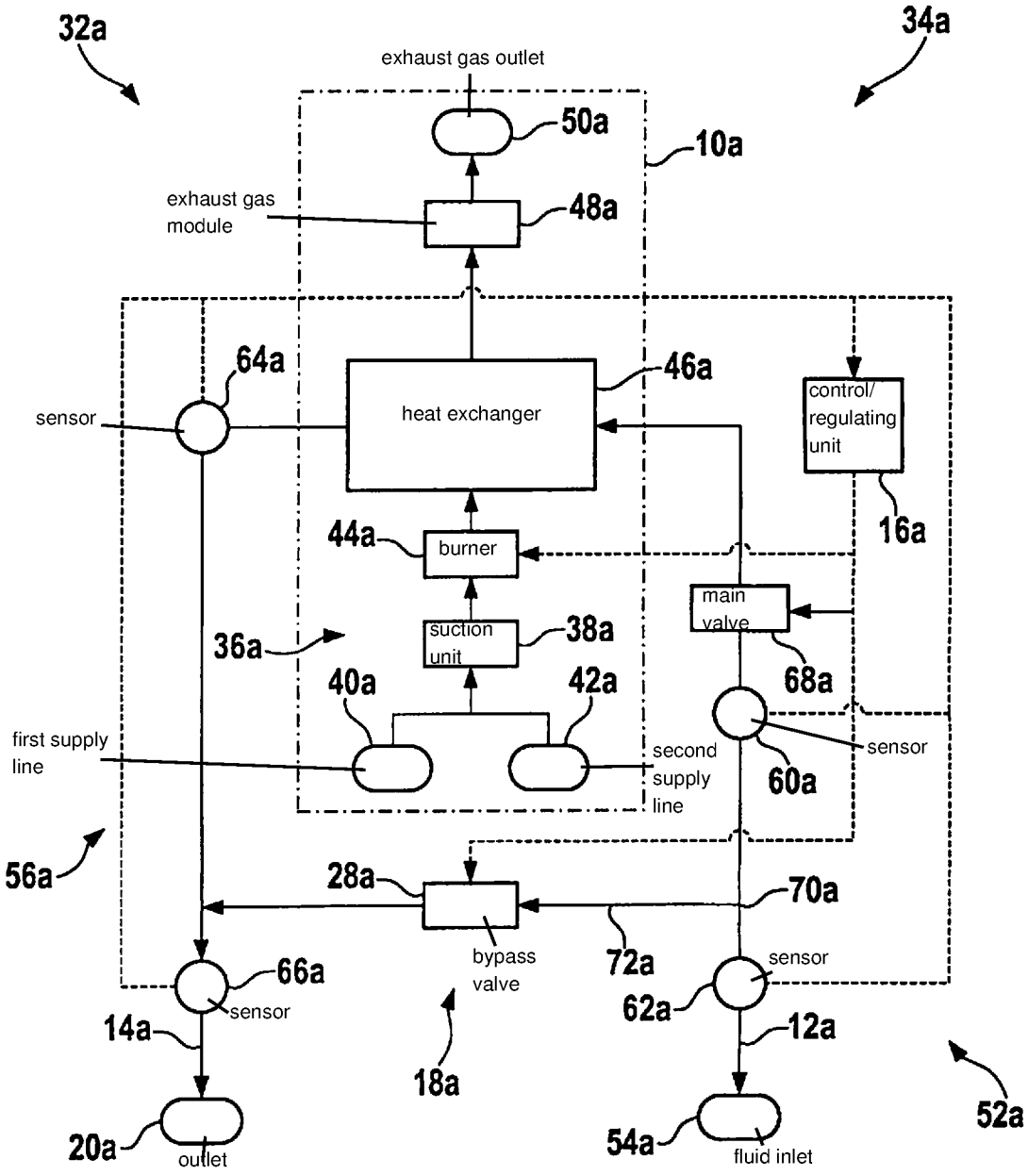
FIG. 1 shows a schematic block diagram of a heater including a heating device.

FIG. 1 shows a schematic block diagram representation of a heater 34*a* exemplarily taking the form of a continuous-flow heater. Heater 34*a* includes a heating device 32*a*. Heating device 32*a* includes a heating unit 10*a*. Heating unit 10*a* is configured to heat a fluid. In the present case, heating unit 10*a* is configured to heat water. To that end, heating unit 10*a* includes a heating module 36*a*. Heating module 36*a* takes the form of a gas burner module. However, as an alternative, it is also conceivable for the heating unit to be configured to heat a different fluid, such as a refrigerant and/or a heating medium. Heating device 32*a* includes a fluid supply line 12*a*, which is provided for supplying the fluid to heating unit 10*a* for heating, and a fluid discharge line 14*a*, which is provided for discharging the fluid from heating unit 10*a* after the heating.

Heating module 36*a* includes a suction unit 38*a*, which is provided for drawing in combustion air and fuel. To that end, suction unit 38*a* is connected to a first supply line 40*a* for combustion air, and to a second supply line 42*a* for fuel. Heating module 36*a* further includes a burner 44*a*. A combustion-air/fuel mixture is supplied to burner 44*a* by suction unit 38*a*. Burner 44*a* is configured to burn the combustion-air/fuel mixture in at least one operating state. In this context, burner 44*a* is configured to produce a heating flame.

In addition, heating unit 10*a* includes a heat exchanger 46*a*. Heat exchanger 46*a* is situated in the vicinity of the heating flame. Heat exchanger 46*a* is configured to transfer thermal energy from heating module 36*a* to the fluid. An unheated fluid, in particular, water, is supplied to heat exchanger 46*a* via fluid supply line 12*a*. Heated fluid is directed out of heat exchanger 46*a* via fluid discharge line 14*a*.

Furthermore, heating unit 10*a* includes an exhaust gas module 48*a*. Exhaust gas module 48*a* takes the form of a chimney. Exhaust gas module 48*a* is provided for removing exhaust gases. To that end, exhaust gas module 48*a* is connected to an exhaust gas outlet 50*a*.

In addition, heating device 32*a* includes a supply unit 52*a*. Supply unit 52*a* is configured to supply the unheated fluid to heat exchanger 46*a* and/or heater 34*a*. To that end, supply unit 52*a* includes a fluid inlet 54*a*. Fluid inlet 54*a* is connected to fluid supply line 12*a*. In addition, supply unit 52*a* includes a main valve 68*a*, which is positioned in fluid supply line 12*a*. Furthermore, heating device 32*a* includes a discharge unit 56*a*. Discharge unit 56*a* is configured to remove the heated fluid from heat exchanger 46*a* and/or heater 34*a*. For that purpose, discharge unit 56*a* includes an outlet 20*a*, which is connected to fluid discharge line 14*a*.

Heating device 32*a* also includes a plurality of sensors 60*a*, 62*a*, 64*a*, 66*a*. A first sensor 60*a* takes the form of a flow rate sensor. A second sensor 62*a* takes the form of a first temperature sensor. Second sensor 62*a* is provided for detecting a temperature of the fluid directly downstream from fluid inlet 54*a*. A third sensor 64*a* takes the form of a second temperature sensor. Third sensor 64*a* is provided for detecting a temperature of the fluid directly downstream from heat exchanger 46*a*. A fourth sensor 66*a* takes the form of a third temperature sensor. Fourth sensor 66*a* is provided for detecting a temperature of the fluid directly upstream from outlet 20*a*.

In addition, heating device 32*a* includes a control and/or regulating unit 16*a*. Control and/or regulating unit 16*a* is configured to control an operation of heating device 32*a*. To that end, control and/or regulating unit 16*a* includes an arithmetic unit, a storage unit, and an operating program, which is stored in the storage unit and is configured to be executed by the arithmetic unit. In addition, control and/or regulating unit 16*a* is configured to set and/or supply the requested heating power. For that purpose, control and/or regulating unit 16*a* has an electrical connection with sensors 60*a*, 62*a*, 64*a*, 66*a*. In addition, control and/or regulating unit 16*a* has an electrical connection with burner 44*a* and main valve 68*a*. Control and/or regulating unit 16*a* is configured to control burner 44*a* and main valve 68*a*. In one operating state, control and/or regulating unit 16*a* is configured to operate heating unit 10*a*, in particular, heating module 36*a*, in a pulsed manner, in order to set a particular temperature.

In addition, heating device 32*a* includes a valve unit 18*a*. Valve unit 18*a* is configured to mix the fluid in fluid discharge line 14*a* with fluid from fluid supply line 12*a*, upstream from outlet 20*a*. Valve unit 18*a* includes a bypass valve 28*a*, which is connected fluidically in parallel with heating unit 10*a*. First sensor 60*a* and main valve 68*a* are situated fluidically in back of a branching-off point 70*a* from fluid supply line 12*a* to a bypass line 72*a* connected to bypass valve 28*a*. Control and/or regulating unit 16*a* is configured to control valve unit 18*a* in such a manner, that a uniform outlet temperature 22*a* of the fluid sets in (cf. FIG. 2).

Figure 2:
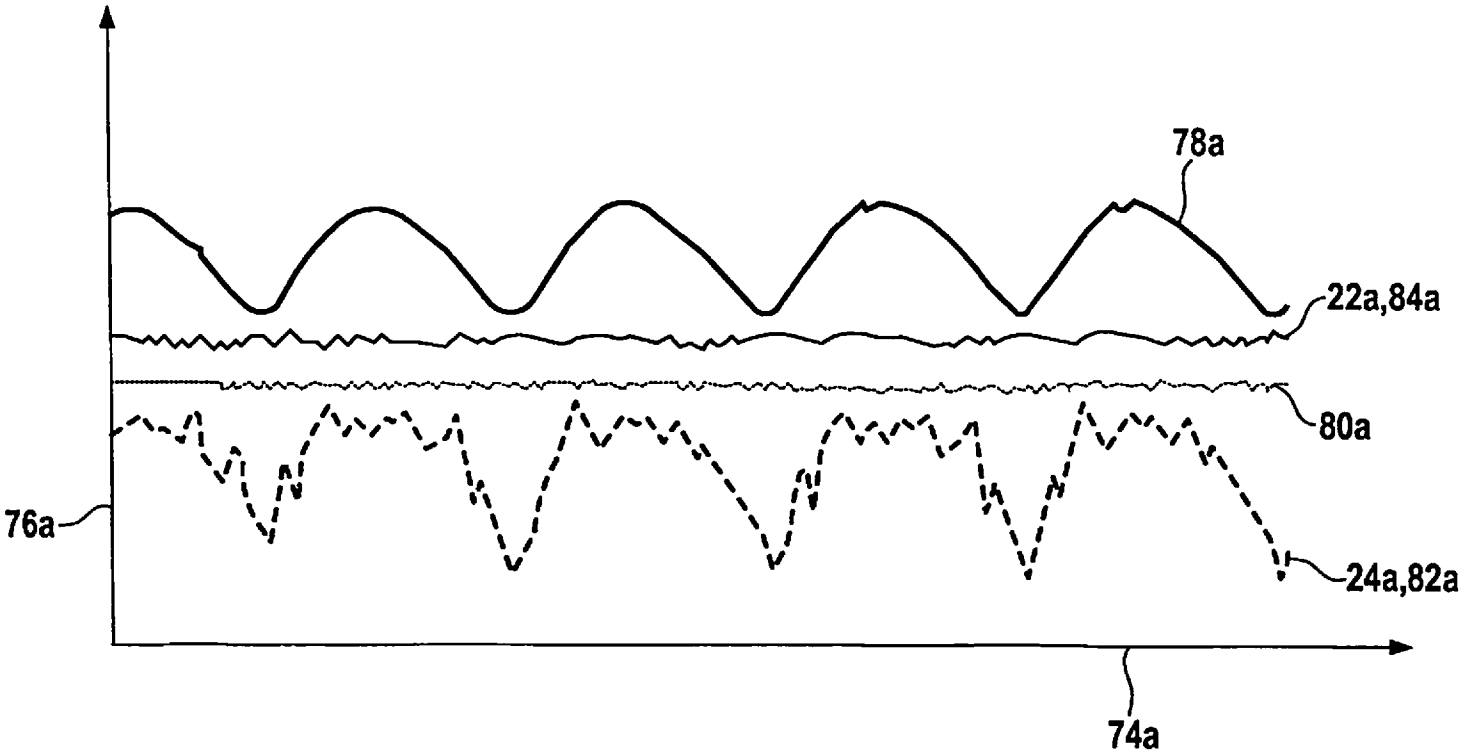
FIG. 2 shows a graphical representation of temperature curves of the heating device and fluid flow rate curves of a valve unit.

FIG. 2 shows a pulsed operating mode. In this context, a time is represented on an abscissa axis 74*a*. An ordinate axis 76*a* is represented as a magnitude axis. In the present case, in the operating state, control and/or regulating unit 16*a* is configured to operate heating module 36*a* in a pulsed manner, in order to set a particular temperature. Control and/or regulating unit 16*a* is configured to operate heating unit 10*a* in a pulsed manner, such that the fluid is heated to a temperature, which lies above a selected outlet temperature 22*a* of the fluid. A curve 78*a* indicates the periodically fluctuating temperature of the fluid immediately downstream from heat exchanger 46*a*, measured by third sensor 64*a*. The fluid in fluid discharge line 14*a* is mixed with fluid from fluid supply line 12*a*, directly upstream from outlet 20*a*. In this context, an inflow amount of the fluid from fluid supply line 12*a* is adjusted with the aid of valve unit 18*a*. A second curve 80*a* indicates the temperature of the fluid immediately downstream from fluid inlet 54*a*, measured by second sensor 62*a*. Control and/or regulating unit 16*a* is configured to control valve unit 18*a* at least substantially synchronously with the pulsed operation of heating unit 10*a*. Control and/or regulating unit 16*a* is configured to increase a flow rate of fluid 24*a* through valve unit 18*a* during pulsed operation, in response to increasing heating power of heating unit 10*a*, and to reduce flow rate of fluid 24*a* through valve unit 18*a* again, during pulsed operation, in response to decreasing heating power of heating unit 10*a*. A third curve 82*a* shows the flow rate of fluid 24*a* through valve unit 18*a* changing synchronously with the temperature of the fluid immediately downstream from heat exchanger 46*a*. A fourth curve 84*a* shows the resulting uniform outlet temperature 22*a* of the fluid by fourth sensor 66*a*.

Figure 3:
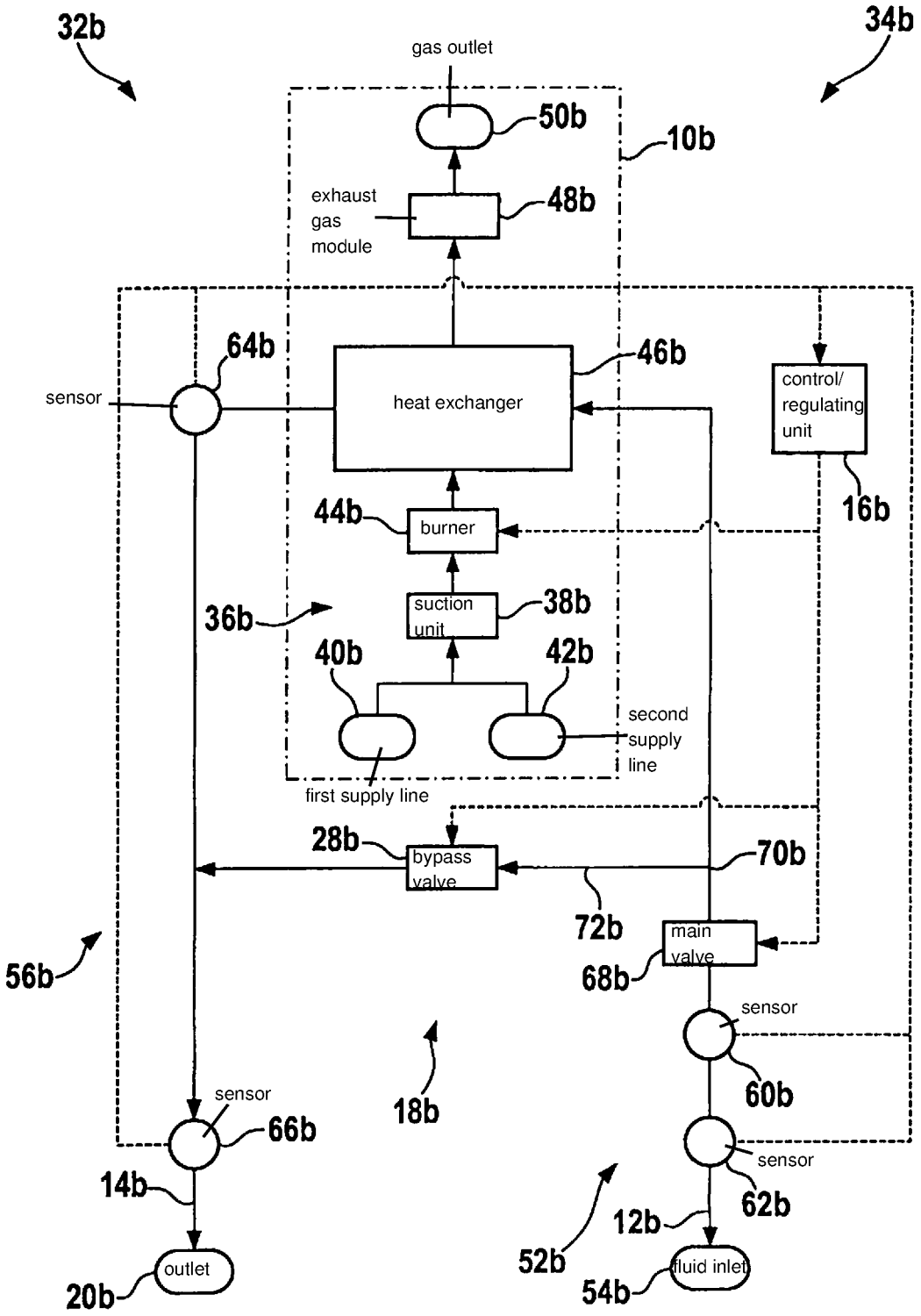
FIG. 3 shows a schematic block diagram of a heater including an alternative heating device.
Figure 4:
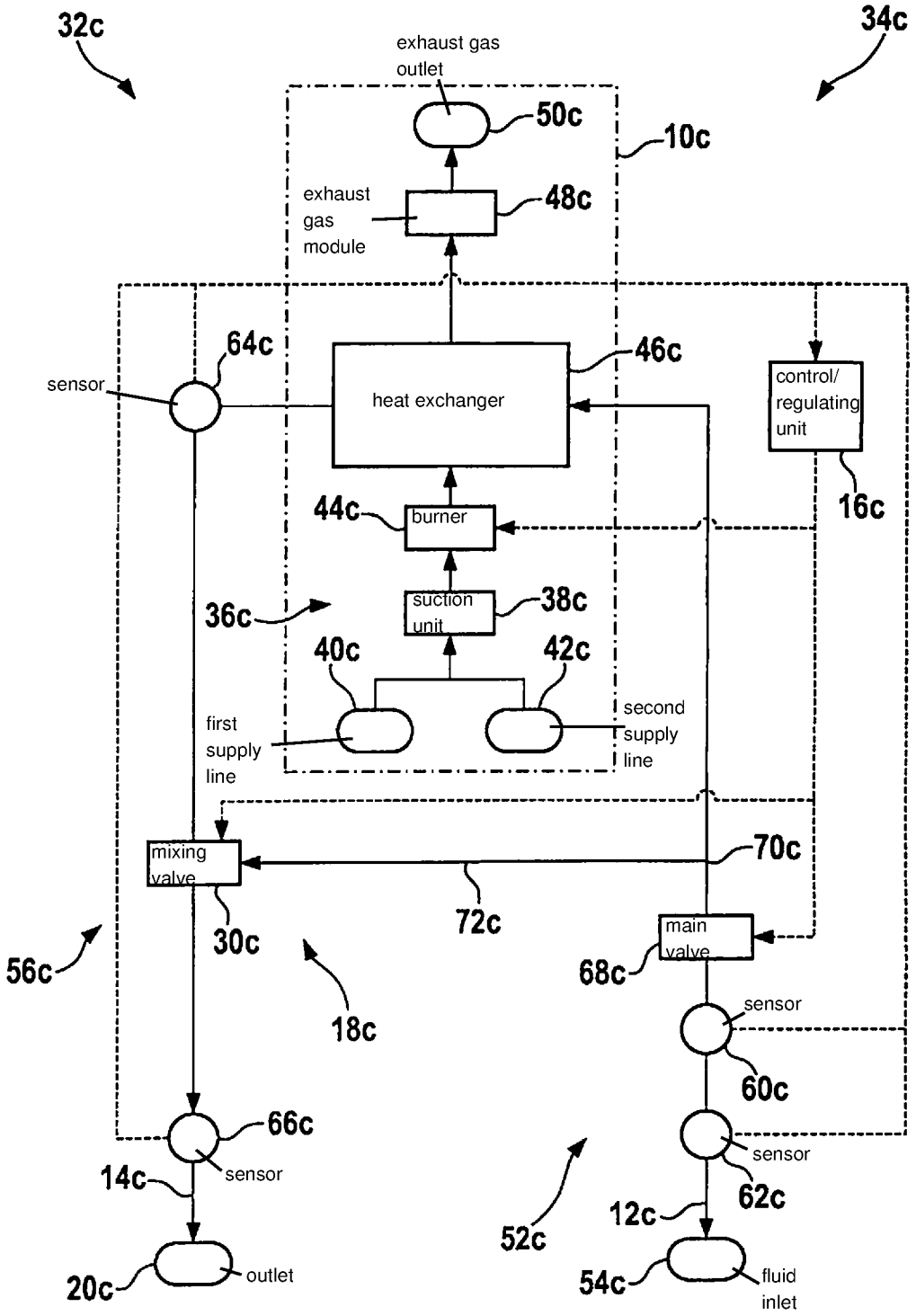
FIG. 4 shows a schematic block diagram of a heater including a further alternative heating device.

Further exemplary embodiments of the present invention are shown in FIGS. 3 and 4. The following descriptions and the figures are mainly limited to the differences between the exemplary embodiments; regarding component parts labeled identically, in particular, with regard to component parts having the same reference numerals, in general, reference may also be made to the figures and/or to the description of the other exemplary embodiments, in particular, of FIGS. 1 and 2. To distinguish the exemplary embodiments, the letter, a, follows the reference numerals of the exemplary embodiment in FIGS. 1 and 2. In the exemplary embodiments of FIGS. 3 and 4, the letter, a, is replaced by the letters, b through c.

FIG. 3 shows an alternative embodiment of a heating device 32*b*. Heating device 32*b* includes a valve unit 18*b*. Valve unit 18*b* is configured to mix a fluid in a fluid discharge line 14*b* with fluid from a fluid supply line 12*b*, upstream from an outlet 20*b*. Valve unit 18*b* includes a bypass valve 28*b*, which is connected fluidically in parallel with a heating unit 10*b*. A first sensor 60*b*, which takes the form of a flow rate sensor, and a main valve 68*b*, are situated fluidically upstream from a branching-off point 70*b* from fluid supply line 12*b* in a bypass line 72*b* connected to bypass valve 28*b*.

FIG. 4 shows a further alternative embodiment of a heating device 32*c*. Heating device 32*c* includes a valve unit 18*b*. Valve unit 18*c* is configured to mix a fluid in a fluid discharge line 14*c* with fluid from a fluid supply line 12*c*, upstream from an outlet 20*c*. Valve unit 18*c* includes a mixing valve 30*c*, which is situated fluidically in fluid discharge line 14*c*. A first sensor 60*c*, which takes the form of a flow rate sensor, and a main valve 68*c*, are situated fluidically upstream from a branching-off point 70*c* from fluid supply line 12*c* in a bypass line 72*c* connected to mixing valve 30*c*.

What is claimed is:

1. A heating device, comprising:

at least one heater configured to heat at least one fluid;

at least one fluid supply line which supplies the at least one fluid to the at least one heater for heating;

at least one fluid discharge line which discharges the at least one fluid from the at least one heater after the heating;

a control and/or regulator which operates the at least one heater in a pulsed manner in at least one operating state to set a particular temperature; and a valve unit which mixes the at least one fluid in the fluid discharge line with fluid from the fluid supply line, upstream from an outlet, wherein the control and/or regulator is configured to control the valve unit at least substantially synchronously with a pulsed operation of the at least one heater by generating and/or outputting a control pulse for controlling the valve unit simultaneously to generating and/or outputting a control pulse for controlling the at least one heater.

2. The heating device as recited in claim 1, wherein the control and/or regulator is configured to control the valve unit so that the at least one fluid has an at least substantially uniform outlet temperature.

3. The heating device as recited in claim 1, wherein the control and/or regulator is configured to increase a flow rate of fluid through the valve unit during the pulsed operation, in response to increasing heating power of the at least one heater.

4. The heating device as recited in claim 1, wherein the control and/or regulator is configured to decrease a flow rate of fluid through the valve unit during the pulsed operation, in response to decreasing heating power of the at least one heater.

5. The heating device as recited in claim 1, wherein the valve unit includes at least one bypass valve, which is situated fluidically in parallel with the at least one heater.

6. The heating device as recited in claim 1, wherein the valve unit includes at least one mixing valve, which is situated fluidically in the fluid discharge line.

7. The heating device as recited in claim 1, wherein the control and/or regulator is configured to operate the at least one heater in a pulsed manner, such that the at least one fluid is heated to a temperature, which lies above a selected outlet temperature of the at least one fluid.

8. A continuous-flow heater, including at least one heating device, the at least one heating device comprising:

at least one heater configured to heat at least one fluid;

at least one fluid supply line which supplies the at least one fluid to the at least one heater for heating;

at least one fluid discharge line which discharges the at least one fluid from the at least one heater after the heating;

a control and/or regulator which operates the at least one heater in a pulsed manner in at least one operating state to set a particular temperature; and a valve unit which mixes the at least one fluid in the fluid discharge line with fluid from the fluid supply line, upstream from an outlet, wherein the control and/or regulator is configured to control the valve unit at least substantially synchronously with a pulsed operation of the at least one heater by generating and/or outputting a control pulse for controlling the valve unit simultaneously to generating and/or outputting a control pulse for controlling the at least one heater.

9. A method for operating a heating device, the heating device including at least one heater which is configured to heat at least one fluid, at least one fluid supply line which supplies the at least one fluid to the at least one heater for heating, at least one fluid discharge line which discharges the at least one fluid from the at least one heater after the heating, and a control and/or regulator which is configured to operate the heater in an at least partially pulsed manner, in at least one operating state, in order to set a particular temperature, the method comprising:

mixing the at least one fluid in the fluid discharge line with fluid from the fluid supply line, upstream from an outlet, wherein the control and/or regulator is configured to control a valve unit at least substantially synchronously with a pulsed operation of the at least one heater by generating and/or outputting a control pulse for controlling the valve unit simultaneously to generating and/or outputting a control pulse for controlling the at least one heater.

* * * * *